US010702002B2

(12) United States Patent
Rogers et al.

(10) Patent No.: US 10,702,002 B2
(45) **Date of Patent: *Jul. 7, 2020**

(54) EASILY ADJUSTED RETENTION SYSTEM FOR HELMETS

(71) Applicant: Artisent, LLC, Simpson, PA (US)

(72) Inventors: David C. Rogers, Boston, MA (US); Edward R. Hall, Somerville, MA (US)

(73) Assignee: GENTEX CORPORATION, Simpson, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/716,316

(22) Filed: Dec. 17, 2012

(65) Prior Publication Data

US 2013/0117913 A1 May 16, 2013

Related U.S. Application Data

(63) Continuation of application No. 11/701,586, filed on Feb. 2, 2007, now Pat. No. 8,353,066.

(60) Provisional application No. 60/842,074, filed on Sep. 1, 2006, provisional application No. 60/765,144, filed on Feb. 4, 2006.

(51) Int. Cl.
*A42B 3/08* (2006.01)
*A42B 3/14* (2006.01)

(52) U.S. Cl.
CPC ..... *A42B 3/08* (2013.01); *A42B 3/085* (2013.01); *A42B 3/14* (2013.01)

(58) Field of Classification Search
CPC .. A42B 3/08; A42B 3/085; A42B 3/14; A42B 1/22
USPC ..... 2/421, 410, 6.6, 422, 6.2, 6.8, 411, 416, 2/417, 425, 9; 24/265 BC, 614–616, 625
See application file for complete search history.

(56) References Cited

U.S. PATENT DOCUMENTS

| | | | | |
|---|---|---|---|---|
| 4,044,400 | A | 8/1977 | Lewicki et al. | |
| 4,335,472 | A | 6/1982 | Rappleyea | |
| 4,398,306 | A | 8/1983 | Gooding | |
| 4,646,368 | A | 3/1987 | Infusino et al. | |
| 4,703,879 | A | 11/1987 | Kastendieck et al. | |
| 4,741,054 | A | 5/1988 | Mattes | |
| 4,753,378 | A | 6/1988 | Kastendieck et al. | |
| 4,793,032 | A | 12/1988 | Crowle | |
| 4,856,119 | A | 8/1989 | Haberle et al. | |
| 4,884,301 | A * | 12/1989 | Aileo | A42B 3/08 2/421 |
| 4,897,888 | A | 2/1990 | Broersma et al. | |
| 5,007,141 | A | 4/1991 | Gentes | |
| 5,077,839 | A | 1/1992 | Keller | |
| 5,083,321 | A | 1/1992 | Davidsson et al. | |
| 5,123,121 | A | 6/1992 | Broersma | |
| 5,179,735 | A | 1/1993 | Thomanek et al. | |
| 5,398,390 | A | 3/1995 | Hede et al. | |
| 5,438,737 | A | 8/1995 | Anscher et al. | |
| 5,459,910 | A | 10/1995 | Anscher | |

(Continued)

*Primary Examiner* — Katharine Gracz
(74) *Attorney, Agent, or Firm* — Morgan, Lewis & Bockius LLP

(57) ABSTRACT

Strap buckles for headgear can be independently adjusted by single-handed operation while the headgear is worn. To tighten the straps, the wearer pulls a strap buckle toward the chin. The adjustment preferably involves a 1:1 length-adjustment ratio, such that the strap is shortened substantially by the amount the wearer pulls on the buckle.

37 Claims, 9 Drawing Sheets

(56) References Cited

U.S. PATENT DOCUMENTS

| | | | | |
|---|---|---|---|---|
| D364,124 | S | 11/1995 | Lortz et al. | |
| 5,469,583 | A | 11/1995 | Akeley et al. | |
| 5,471,678 | A | 12/1995 | Dor et al. | |
| 5,581,819 | A | 12/1996 | Garneau et al. | |
| 5,608,918 | A | 3/1997 | Salvaggio et al. | |
| 5,685,020 | A | 11/1997 | Powell et al. | |
| 5,898,950 | A | 5/1999 | Spyrou et al. | |
| 5,911,315 | A | 6/1999 | Flowers | |
| 5,996,192 | A | 12/1999 | Haines et al. | |
| 6,059,634 | A * | 5/2000 | Fildan | A41F 15/002 24/197 |
| 6,311,338 | B1 | 11/2001 | Galet et al. | |
| 6,368,180 | B1 * | 4/2002 | Dailey | A41C 3/12 2/300 |
| 6,463,638 | B1 | 10/2002 | Pontaoe | |
| 6,532,602 | B2 | 3/2003 | Wailers et al. | |
| D483,294 | S | 12/2003 | Uehara et al. | |
| D496,305 | S | 9/2004 | Anscher et al. | |
| 6,804,829 | B2 | 10/2004 | Crye et al. | |
| 6,854,133 | B2 | 2/2005 | Lee et al. | |
| D510,294 | S | 10/2005 | Funo et al. | |
| D510,297 | S | 10/2005 | Funo et al. | |
| 7,600,268 | B2 | 10/2009 | Rogers et al. | |
| 8,353,066 | B2 * | 1/2013 | Rogers et al. | 2/421 |
| 2003/0115661 | A1 * | 6/2003 | Dobbie | A42B 1/046 2/422 |
| 2004/0003452 | A1 | 1/2004 | Schiebl | |
| 2004/0226147 | A1 | 11/2004 | Fildan et al. | |
| 2005/0210567 | A1 | 9/2005 | Rogers et al. | |
| 2005/0241050 | A1 | 11/2005 | Pietrzak et al. | |

* cited by examiner

EASILY ADJUSTED RETENTION SYSTEM FOR HELMETS

RELATED APPLICATIONS

The present application claims priority to, and the benefits of, U.S. patent application Ser. No. 11/701,586 which was filed on Feb. 2, 2007, which claims priority to, and the benefits of, U.S. Provisional Application Ser. No. 60/765,144, filed Feb. 4, 2006 and 60/842,074, filed on Sep. 1, 2006, the entire disclosures of which are hereby incorporated by reference.

RELATED APPLICATION

The present application claims priority to, and the benefits of, U.S. Provisional Application Ser. Nos. 60/765,144, filed Feb. 4, 2006, and 60/842,074, filed on Sep. 1, 2006, the entire disclosures of which are hereby incorporated by reference.

FIELD OF THE INVENTION

This invention relates generally to safety helmets and, in particular, to helmet straps and their adjustment.

BACKGROUND OF THE INVENTION

Helmets for head protection are worn in a variety of environments and for various purposes. Helmets are often secured to a wearer's head by a flexible chin strap. The chin strap may include multiple segments of flexible strap material that are secured at either side of the helmet and pass below the chin, where the segments are releasably joined. In some helmets the strap segments on either side of the helmet are attached to the helmet at two positions, in front of and behind the wearer's ear. When joined, the two strap segments form a single strap that may be adjusted in length. Many of the available approaches to connecting the strap segments are cumbersome and lack security. In some cases, for example, the wearer must pass one end of the strap through a buckle or a pair of "D-rings" with a return loop, making it difficult to quickly remove the helmet in an emergency. In other cases, a quick release "snap" lacks security due to the possibility of accidental release. Two-finger release mechanisms, while more secure, typically attach to the ends of the strap segments and thus require intervening length in line with the straps. This makes it difficult to place the fastener near the chin, which can be important to the stability of the helmet.

Conventional helmet straps may also be difficult to adjust. If only a single strap is provided on each side of the helmet, for example, the adjustment can be made at the buckle where the straps are joined. If the chin strap has connections at two positions on each side of the helmet, however, the two separate strap segments each need adjustment for length, but generally have no convenient buckle or termination to accommodate such adjustment. A typical approach for adjusting the length of these strap segments is to fix one end of the strap and loop the free end through a buckle or loop, returning it to a ladder-lock adjustment mechanism positioned along the length of strap. By pushing more or less of the free end through the ladder lock, the length of a strap segment is altered. The geometry of this solution dictates that for each inch of length adjustment, the free end must move two inches. The free strap end that extends beyond the ladder lock may be secured with an additional component such as a clasp, or in some designs the wearer can adjust the position of the ladder lock along the strap segment to minimize the length of the exposed strap. In any case, the result is that adjusting the length of helmet straps is neither fast nor convenient and may require removing the helmet and making multiple adjustments, repositioning the ladder lock, and trying the helmet again for proper fit.

While adjustment theoretically is needed only when the helmet is first acquired, in practice the wearer may wish to adjust the tightness of the straps according to circumstances. In active situations, for example, especially if additional accoutrements such as night-vision goggles are attached to the helmet, the wearer may wish the straps to be tighter than normally required.

SUMMARY OF THE INVENTION

The present invention provides practical and reliable solutions to the foregoing problems. In various embodiments, the invention provides a secure retention system for protective helmets that facilitates easy adjustment. For protective headgear attached in four positions, the lengths of each of the four straps can be independently adjusted without having to push or withdraw the strap ends through a buckle or ladder-lock device. In preferred embodiments, four independently adjustable straps that attach to the back of the helmet on left and right sides engage a bridging nape pad such that tightening the straps urges the nape pad forward to press against occipital lobe of the wearer's head, and this tightening may be accomplished by sliding strap buckles toward the chin. This approach is particularly well-suited to wearers who must have protective headgear in place for extended periods, because the wearer may shorten or lengthen the helmet retention straps quickly and conveniently.

In general, preferred embodiments of the invention include strap buckles that can be independently adjusted by single-handed operation while the headgear is worn. To tighten the straps, the wearer pulls a strap buckle toward the chin, a direction that is natural for the wearer and efficient because it is in the direction that the wearer wants the helmet to move. The adjustment preferably involves a 1:1 pull-down ratio, such that the strap is shortened substantially by the amount the wearer pulls on the buckle.

In one embodiment, a strap assembly in accordance with the invention comprises a chin-holding component; retention components at the front left and right sides of the wearer's head each comprising a forward strap connecting to the front-side of the helmet, rear left and right retention components connecting to the rear of the helmet and, desirably, an adjustment buckle as described above associated with each retention component that allows independent adjustment of the strap lengths to the chin-holding component; a nape pad engaging the rear retention components; and a releasable coupling component between the chin-holding component and retention components on at least one side of the helmet.

In some preferred embodiments, the adjustment buckle includes a central cross-member to which one end of a strap segment is secured; a pair of slots parallel to the central cross-member configured so that the flexible strap can pass upward through one slot, over the central member and down through the second slot; and a finger notch or indentation area facilitating manual engagement of the buckle to slide it along the strap length. The slots of the buckle are desirably shaped such that when the buckle is in its normal orientation, they create a gripping contact with the flexible strap to inhibit the strap segment from sliding through the slots. In a second orientation, however, the gripping contact surfaces are angled to permit the strap to slide easily through the slots.

Angular movement from the gripping orientation to the sliding orientation is accomplished by pinching the buckle in the finger-indentation area and pulling so as to rotate the buckle about an axis running essentially through the central cross-member.

In various embodiments, the strap configuration includes a two-finger-releasable connecting device for attaching flexible strap segments. For example, a releasable two-part buckle in accordance with the invention may comprise a male component attached at one end to a flexible strap segment and having at least two fingers extending from the other end of the component, which can snap-engage a female component. The engagement can be released by simultaneously pressing the two fingers. Flush abutment between flat surfaces of the male and female components without significant intervening linear space helps maintain tension between the strap components.

In a preferred embodiment, the female component of the connecting device has a pass-through area along its underside, parallel to the direction of introduction of the male component, through which a flexible strap segment is passed to terminate at a flat surface which abuts the male component. When the male and female components are joined, the two opposed, flat surfaces abut each other, thus bringing the two flexible straps substantially together without significant intervening space. In some embodiments, two V-shaped strap segments, one with its apex terminating at the flat surface of the male component and the other with its apex terminating at the flat surface of the female component, are thereby drawn into an "X" configuration that channels the tension in the straps along continuous lines, rather than allowing the tension to dissipate in an intervening length of strap.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION OF THE PREFERRED EMBODIMENTS

Figure 1:
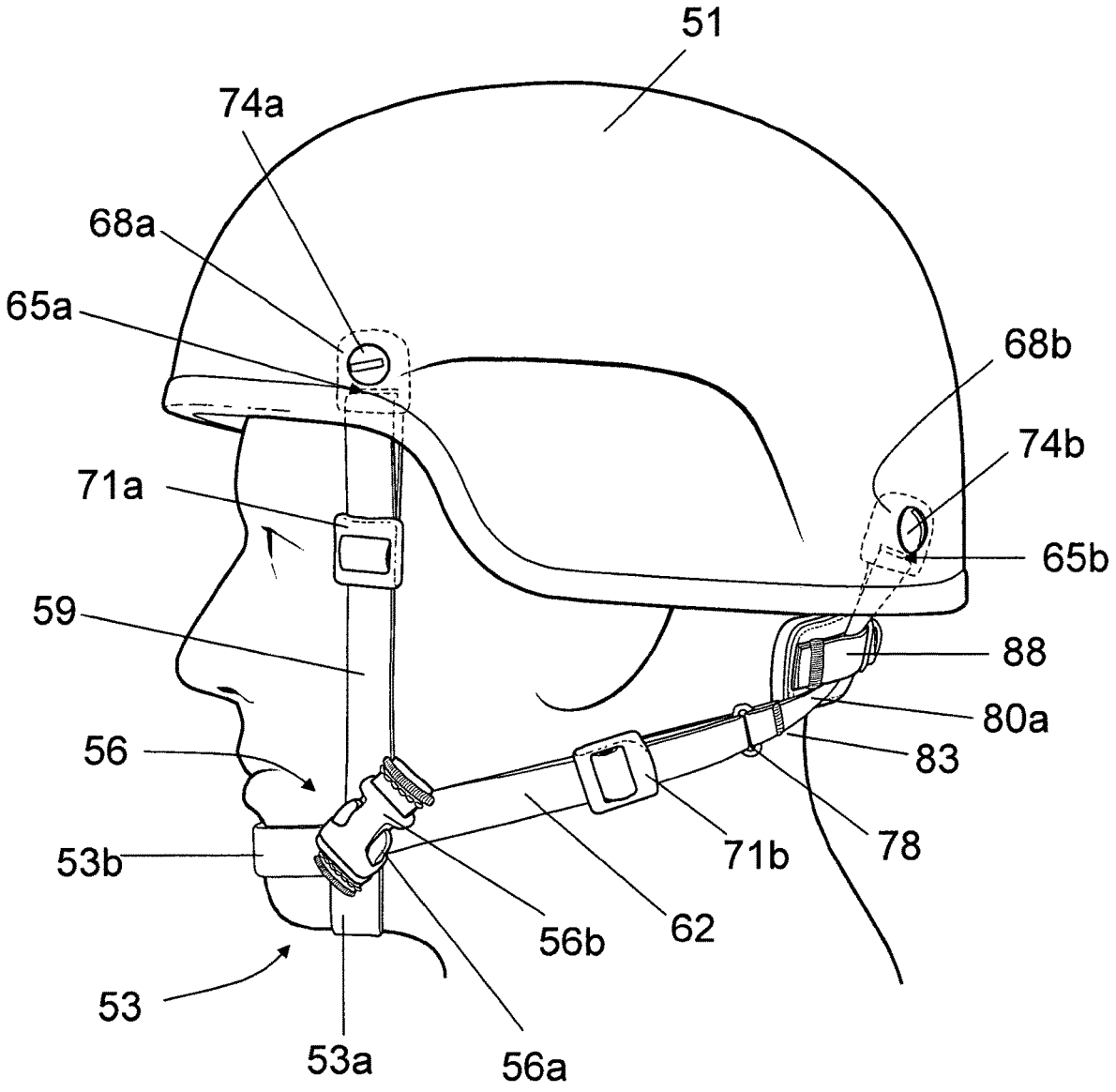
FIG. 1 is a side elevational view of a protective helmet secured to the wearer's head by means of the retention system of the present invention.

With reference to FIG. 1, a helmet comprising a rigid helmet shell 51 is positioned on a wearer's head and secured by the retention system of the present invention. The retention system engages the wearer's chin by means of a chin holder 53, which preferably comprises a first member 53*a*, which passes below the chin, and a second member 53*b*, which passes between the chin and the lower lip. The chin holder 53 is joined to retention straps using a coupling component 56, a preferred embodiment of which is described below, although any suitable quick-disconnect fitting may be used. The coupling component 56 desirably provides a secure, two-finger-activated device that allows the retention straps to be disjoined on at least one side of the wearer's head to allow the helmet to be worn and removed. In the preferred embodiment, there is only one coupling component 56 on the left or the right side according to the wearer's preference. The coupling component 56 is shown in FIG. 1 on the wearer's left side. Other components on the illustrated left side are found in similar positions on the right side of the retention system.

As may be seen in FIG. 1, the retention system further comprises a forward strap 59 connected to the coupling component 56 and extending upward to the side of the helmet 51 toward the front. The forward strap on the right side or the wearer (not shown) is connected by sewing or other means directly to the chin coupling members 53*a*, 53*b*. To facilitate attachment of the forward strap 59 to the helmet shell 51, the strap passes through a slot 65*a* in a strap anchor 68*a* and loops back to a strap buckle 71*a*, which is further described below. As may be seen in more detail in FIG. 4*a*, the strap anchor 68 is secured to the interior surface of helmet shell 51 with a fastener 74 (e.g., a screw), which first passes through a hole 75 in helmet shell 51 and then through a mounting hole 76 in strap anchor 68, finally engaging a T-nut 77 or similar complementary fastening component on the inside of the helmet 51.

With renewed reference to FIG. 1, the rearward strap assembly comprises a first strap 62 that passes through a ring 78 and loops back to strap buckle 71*b*, which is preferably identical to buckle 71*a* and will be described below. The rearward strap assembly further comprises a back strap 80*a* secured to ring 78 by looping a first end through the ring and sewing or otherwise permanently affixing this first end to back strap 80*a*, as indicated at 83. The second end of back strap 80*a* ascends and is secured through slot 65*b* of anchor 68*b*. Anchor 68*b*, in turn, is attached to helmet shell 51 by means of a fastener 74*b*, in the same manner anchor 68*a* is secured at the front of the helmet 51.

Figure 2A:
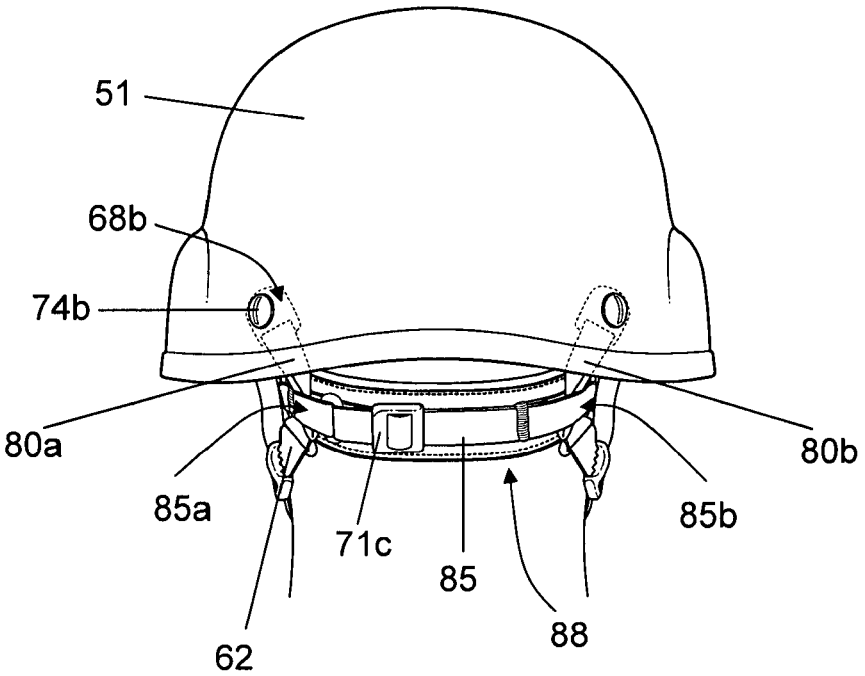
FIG. 2*a* is rear elevational view back showing the nape pad of the present invention.
Figure 2B:
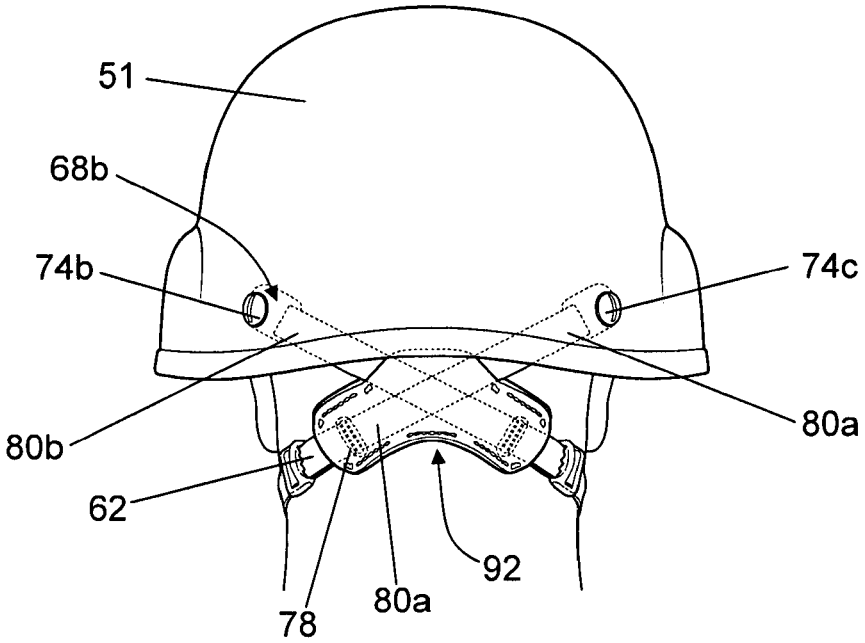
FIG. 2*b* is a rear elevational view showing an alternative embodiment of the nape pad in which the back straps cross to the opposite side of the helmet.

As shown in FIG. 2*a*, a nape strap 85 is associated with a nape pad 88 to facilitate adjustment of the nape pad fit to the back of the wearer's head. One end of nape strap 85 forms a left-side loop 85*a* through which back strap 80*a* passes and the other end forms a similar right-side loop 85*b* through which back strap 80*b* passes. In the preferred embodiment, nape strap 85 includes a strap buckle 71*c*, which facilitates adjustment of the distance between back strap 80*a* and 80*b*. In the alternate embodiment shown in FIG. 2*b*, a nape pad 92 is formed in the shape of the letter "X" with passages for back straps 80*a*, 80*b*, which cross each other and are secured to anchors 74*b*, 74*c* on opposite sides of the helmet from which they originate. The rearward strap 62 extends only to ring 78 at the edge of the nape pad 88 (or 92). Back straps 80*a*, 80*b*, are fixed-length and are not required to slide through the nape pad when adjusting the rearward strap assembly 62 on the left side (or the similar rearward strap on the right side).

Figure 3:
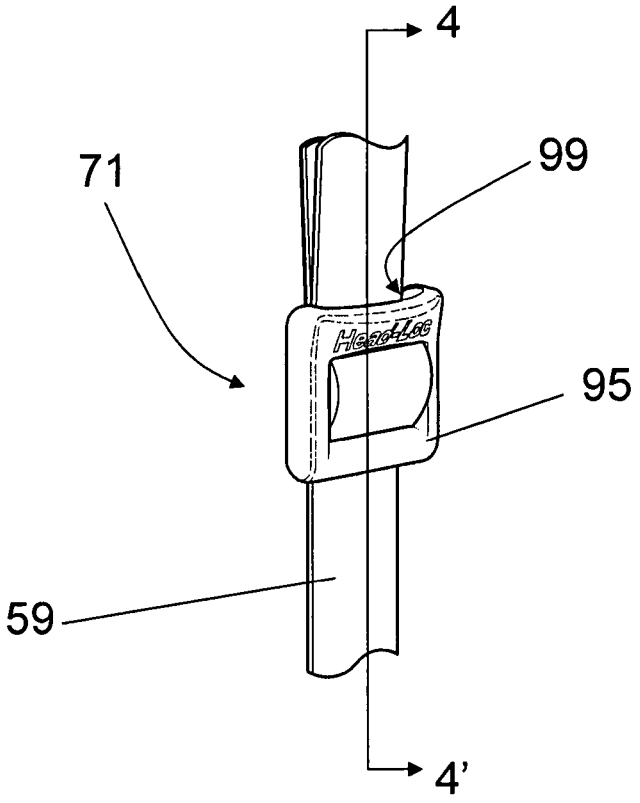
FIG. 3 is a perspective view of a strap buckle in accordance with the present invention.

With reference to FIG. 3, the strap buckles 71 of the present invention engage each of the two forward straps (left forward strap 59 being shown) and two rearward strap assemblies to allow independent adjustment of their lengths. The illustrated embodiment of strap buckle 71 comprises a frame 95 with slots configured so that a flexible strap can pass upward through one slot, over a central member and down through the second slot. A finger indentation area 99 is formed by an outwardly flared surface of frame 95 to facilitate engagement of the strap buckle in order to rotate it about its central member.

Figure 4A:
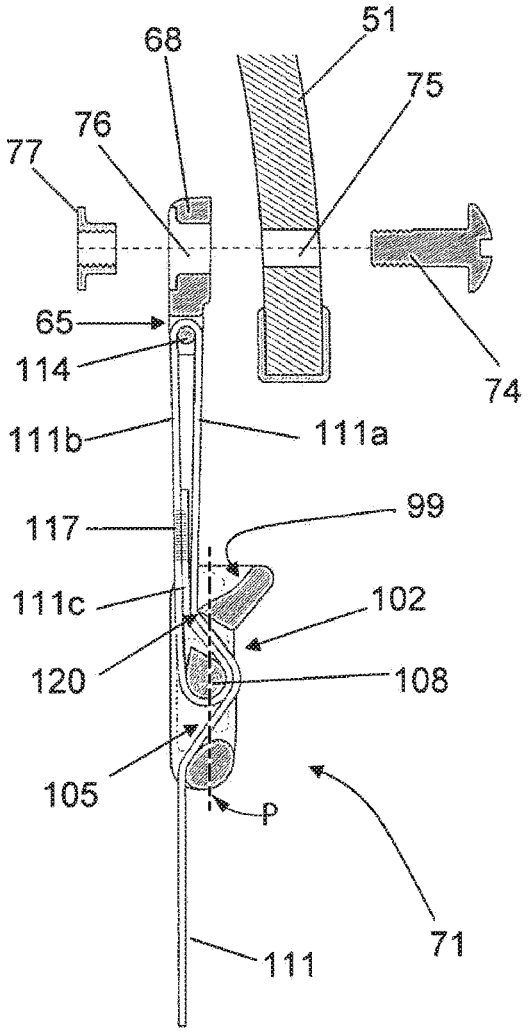
FIG. 4*a* is a sectional view of the strap buckle of FIG. 3 in its normal orientation.
Figure 4B:
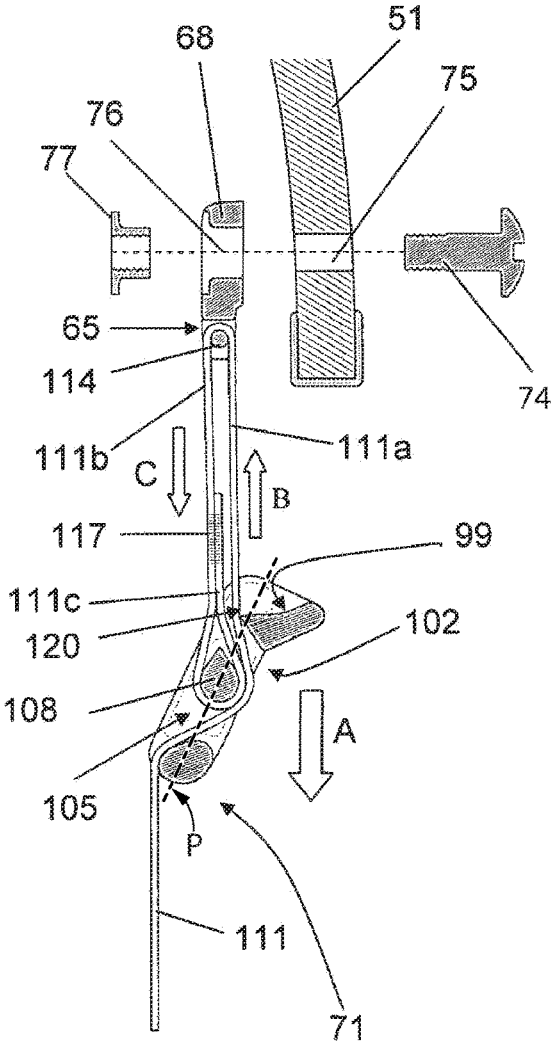
FIG. 4*b* is a sectional view showing the strap buckle of FIG. 4*a* rotated in orientation to allow the straps to slide.

With reference to FIG. 4*a* and FIG. 4*b*, the strap buckle 71 includes a gripping slot 102 and a sliding slot 105, both formed generally by the frame 95 and the central cross-member 108. The frame 95 includes a flat imaginary reference plane P. The flexible strap indicated generally at 111 passes up through sliding slot 105, over central cross-member 108, and then down through gripping slot 102. Segment 111*a* of strap 111 continues beyond strap buckle 71 to anchor 68, where it loops through slot 65 and around a pin 114. Segment 111*b* of strap 111 returns to strap buckle 71, passing around the central cross-member 108, and end segment 111*c* of strap 111 is secured to itself to form a closed loop around cross-member 108 by sewing or other suitable means (as indicated at 117). The inwardly facing surface of finger indentation area 99 is formed with a sharp, angled surface 120 such that that when strap buckle 71 is in its normal orientation, a tensioning force on strap 111 causes angular surface 120 to press against flexible strap segment 111*a*, thereby creating a frictional contact with the strap segment 111*b* and strap end 111*c*. This frictional engagement resists sliding of the flexible strap 111 through the strap buckle 71.

The wearer moves the strap buckle 71 to the orientation shown in FIG. 4*b* to adjust the length of the flexible strap 111. In this orientation, the angular surface 120 disengages from strap 111*b* and strap end 111*c*, thus allowing flexible strap 111 to slide unimpeded through the strap buckle 71. This rotational movement from the gripping orientation of FIG. 4*a* to the sliding orientation of FIG. 4*b* is easily accomplished by pulling on the finger indentation area 99 to draw the upper edge of frame 95 downward, rotating the buckle about an axis running essentially through the central cross-member 108. If the wearer combines the rotational movement described above with a downward force (as indicated by arrow "A"), the strap buckle 71 draws strap end 111*c* downward. The downward motion of strap end 111*b* (as indicated by arrow "C"), in turn, causes strap segment 111*a* to slide upward (as indicated by arrow "B") by an equivalent amount. Since strap segment 111*a* is part of flexible strap 111, pulling buckle 71 downward shortens the distance between the pin 114 of anchor 68 and the lower end of flexible strap 111, which is secured at the chin holder, thereby tightening the helmet on the wearer's head. As can be seen from FIGS. 4*a* and 4*b*, the length of strap 111 is shortened exactly by the amount the wearer draws down buckle 71, providing a 1:1 length-adjustment ratio. To loosen the retention system of the present invention, the wearer rotates the strap buckle as in FIG. 4*b* and applies an upward force such that the arrows "A," "B," and "C" of FIG. 4*b* are reversed.

Figure 5:
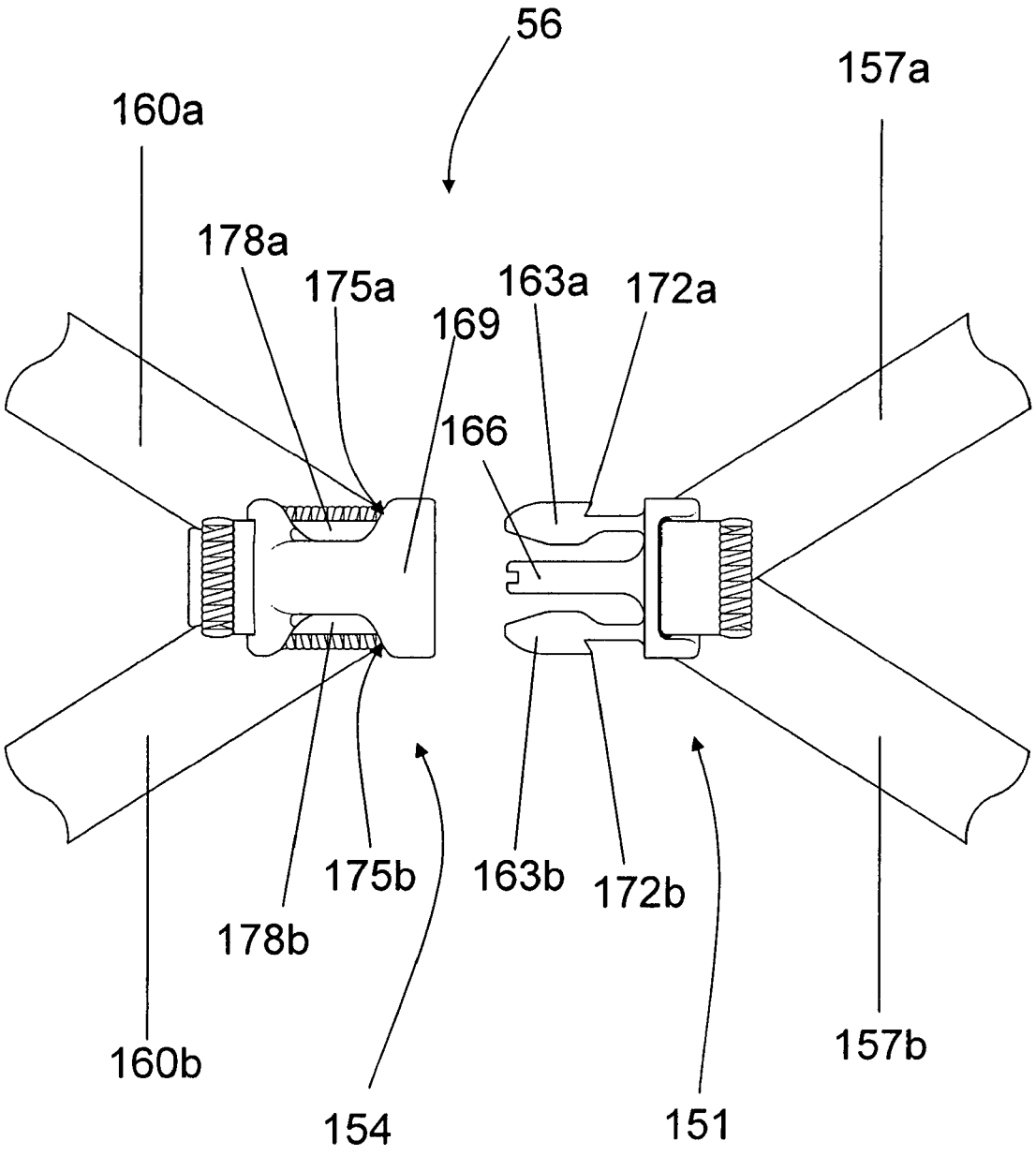
FIG. 5 is a plan view of the male and female components of a buckle in accordance with the present invention.

FIGS. 5-9 illustrate a preferred coupling component 56 in the form of an attachment buckle. With reference to FIG. 5, a preferred buckle 56 comprises a male component 151 and a female component 154 coupling together flexible straps comprising, with respect to male component 151, strap segments 157*a*, 157*b*, and with respect to female component 154, strap segments 160*a*, 160*b*. Male and female components 151, 154 are preferably molded from a strong, flexible, resilient plastic material such as Nylon or Delrin. The fingers 163*a*, 163*b* and guide member 166 are received within a receptacle area 169 of the female component 154 using normal manual pressure. During this coupling movement, fingers 163*a* and 163*b* deflect laterally toward guide member 166 until engaging features 172*a*, 172*b* have cleared surfaces 175*a*, 175*b* of the female component 154. At this point, the flexibility of the fingers 163*a*, 163*b* cause them to return outwardly to their uncompressed position, so that surfaces 175*a*, 175*b* resist return movement of engaging features 172*a*, 172*b*, thereby preventing separation of the male component 151 from the female component 154. The female component 154 has openings 178*a*, 178*b* that afford access to fingers 163*a*, 163*b* following insertion of the male component 151 into the female component 154.

Figure 6:
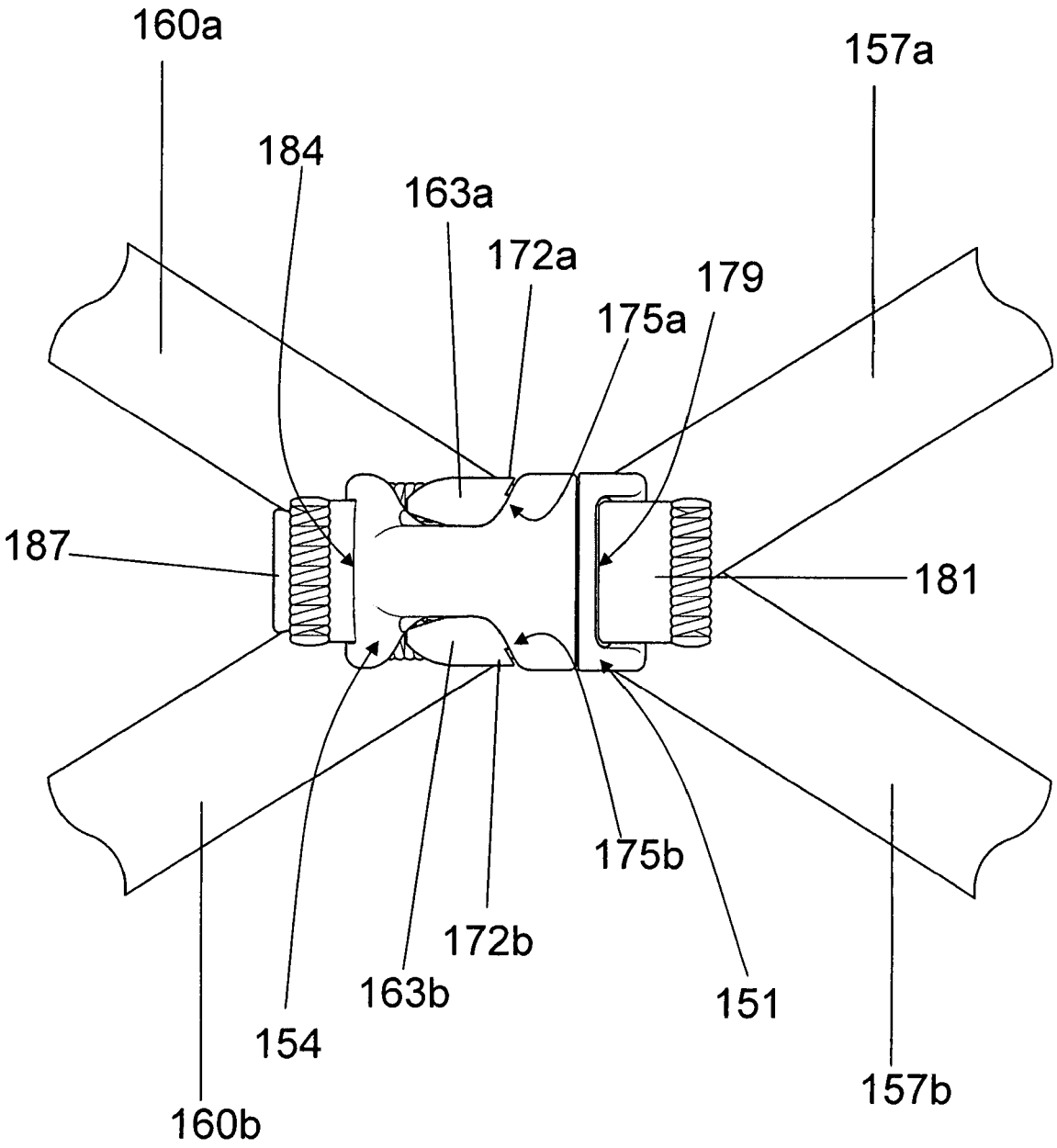
FIG. 6 is a plan view of the buckle of FIG. 5 in the connected position.
Figure 7:
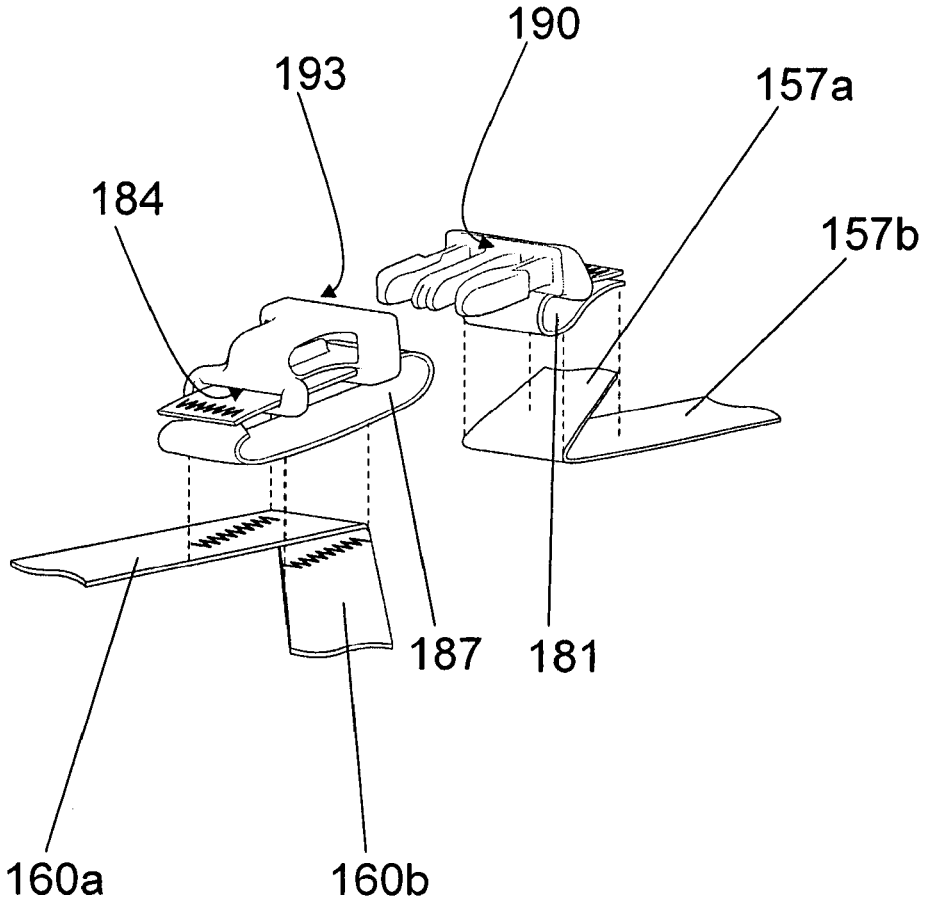
FIG. 7 is an exploded view of the buckle of the present invention showing the flexible straps to which the male and female components are to be connected.

With reference to FIGS. 6 and 7, fingers 163*a*, 163*b* are sufficiently exposed through the openings in the female component 154 to permit the wearer to pinch the fingers and flex them inwardly, thereby freeing the engaging features 172*a*, 172*b* from surfaces 175*a*, 175*b* and allowing the male component 151 to be withdrawn from the female component 154. A flexible intermediate strap 181 passes through a slot 179 in male component 151, and a flexible intermediate strap 187 is secured to female component 154 through a pass-through area 187.

In the preferred embodiment, intermediate strap 181 is sewn or otherwise permanently affixed to the flexible strap components 157*a*, 157*b*. As illustrated, the components 157*a*, 157*b* are part of the same single length of strap, which is folded to form a V-shaped configuration. Alternatively, however, components 157*a*, 157*b* can be separate strap segments that are joined to form the same configuration. In either case, the apex of the V is substantially aligned (i.e., flush) with the abutment face 190 of male component 151, which, when the male and female components are locked, makes contact with a complementary abutment surface surface 193 of the female component 154. As a result, the edges of the V-shaped straps at their apices are substantially in contact along the entire apex edge length.

Similarly, the pass-through area 184 in the female component accepts intermediate strap 187, which is sewn or otherwise affixed to strap segments 160*a*, 160*b* and positioned so that the apex of the V is substantially flush with the abutment surface 193. The pass-through area 184 is oriented parallel to the direction of introduction of the male component 154, and locates the tensioning region of the strap segments 160*a*, 160*b* adjacent the front surface 193 of the female component 154, very close to the point where the female component joins the male component.

It is also possible to utilize the invention with single linear strap segments rather than V-shaped segments. In this case, the male component 151 may be connected to one of the single straps directly through the slot 179 instead of employing the intermediate strap 181, and the female component

154 may be connected directly to the other single strap using the pass-through area 184, thereby obviating the need for the intermediate strap 187. Another alternative is to use one free, single strap and one V-shaped strap, in which case it is advantageous for the male component 151 to be connected to the single strap directly through the slot 179 and the female component 154 to be connected to the V-shaped strap via intermediate strap 187.

Figure 8:
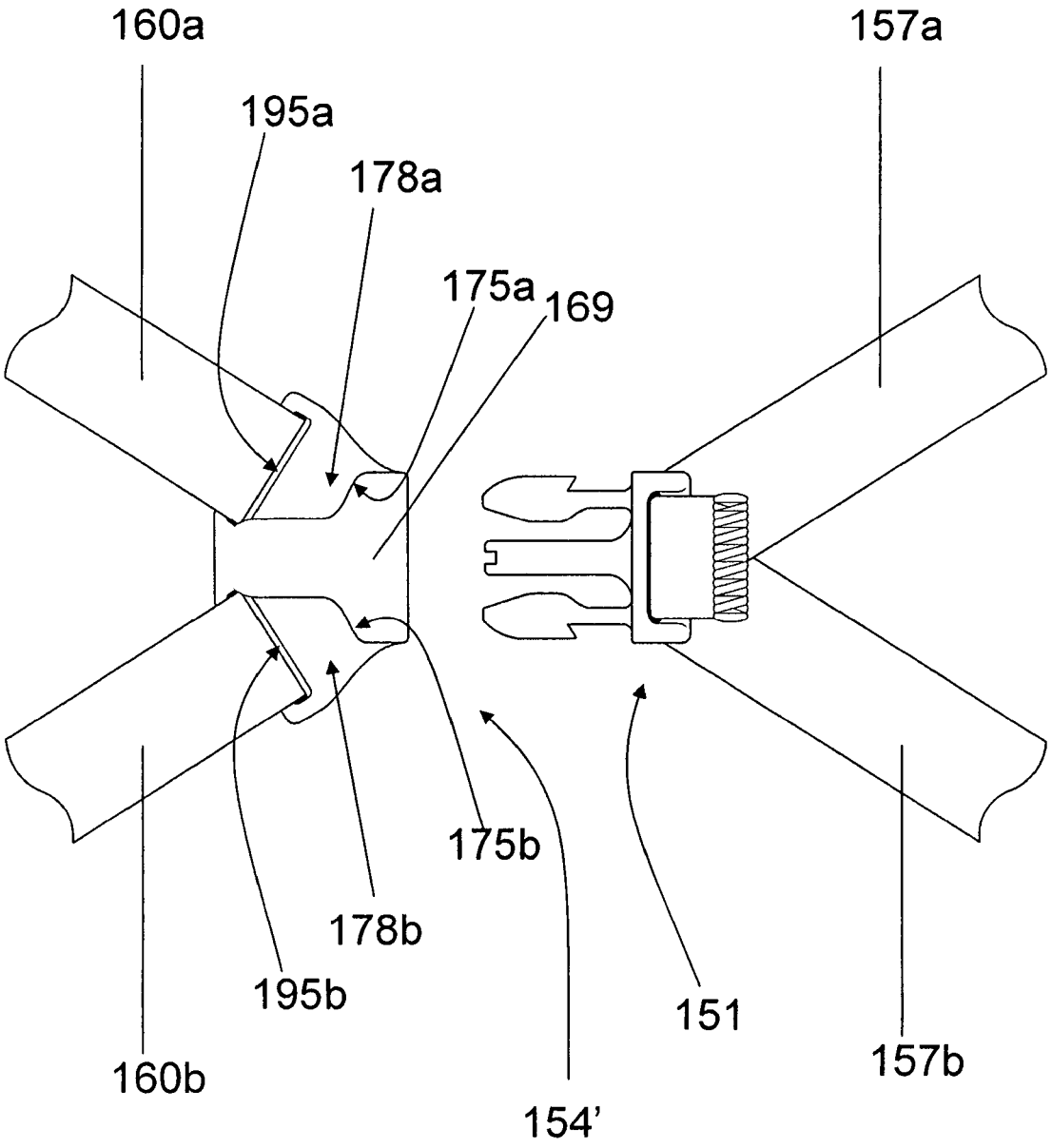
FIG. 8 shows another embodiment of the present invention in plan view.

FIG. 8 illustrates another embodiment 154' of the female component. The component 154' has many of the same features as the female component 154 shown in previous figures, including receptacle area 169, surfaces 175*a*, 175*b*, and openings 178*a*, 178*b* which cooperate with features of the male component 151 as described previously. Straps 160*a*, 160*b* are attached to the component 154' via mounts such as the slots 195*a*, 195*b*. This embodiment is particularly well suited to applications where two straps are joined at the female side with one or two straps on the male side.

Figure 9:
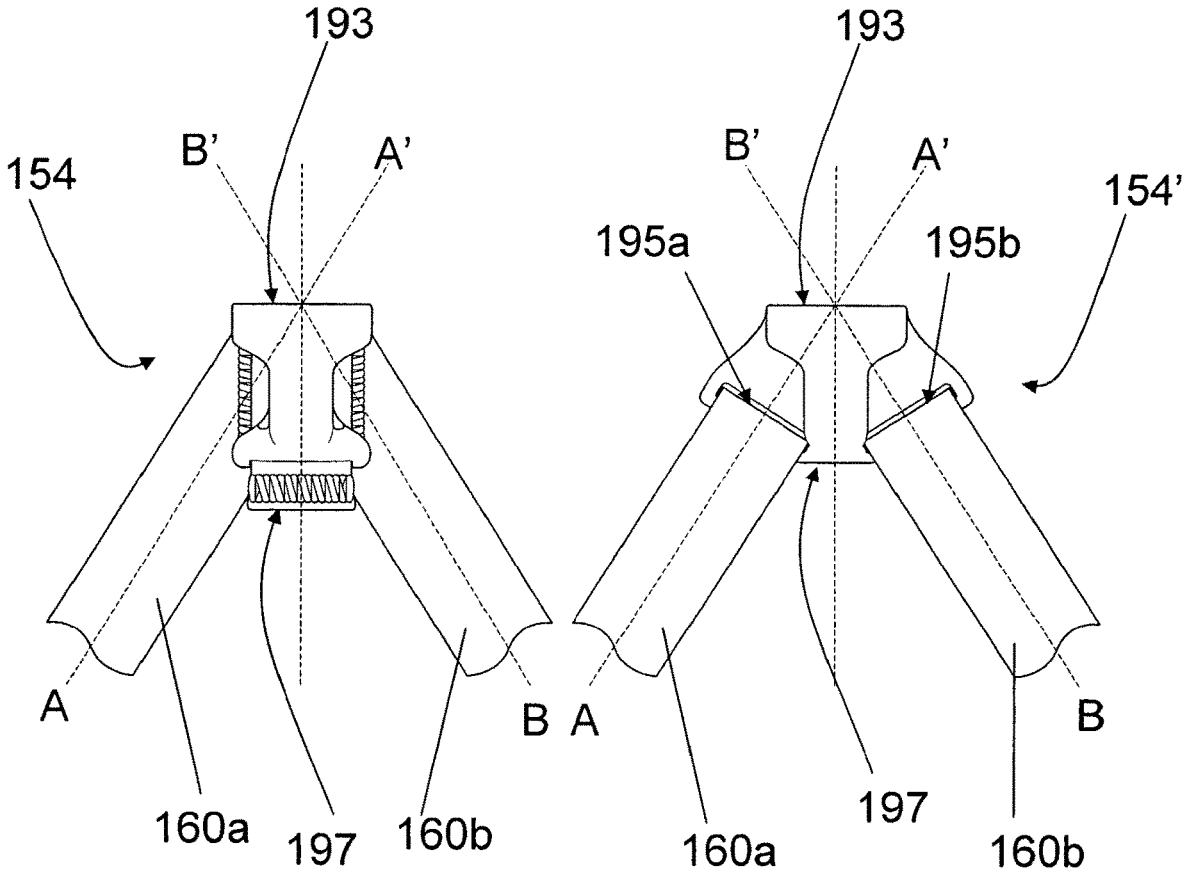
FIG. 9 shows the two embodiments of the female component of the buckle taken from FIG. 5 and FIG. 8 to illustrate the critical geometry of the present invention.

FIG. 9 shows how both female components 154 and 154' share the critical geometry that allows tension to pass through the buckle without being dissipated by intervening linear space. The dotted lines A-A' and B-B' follow the tension in the flexible straps 160*a*, 160*b* respectively. The slots 195*a*, 195*b* are angled toward each other so that the lines of tension A-A' and B-B' intersect each other at or very near the front surface 193 of the female component. As can be seen in FIG. 9, both embodiments 154 and 154' of the female component provide this geometry. When the male and female components are engaged, these lines of tension are substantially continuous—that is, the lines A-A' and B-B' shown in FIG. 9 are substantially congruent with complementary lines from the V-shaped strap of the male component. This is because when the male and female portions of the buckle are locked, the V-shaped straps come together to form the letter "X," so that tension in the opposed straps are aligned. This has been found to substantially improve helmet stability.

With renewed reference to FIG. 1, the straps of the chin-holding component 53 are joined to the male component of the buckle 56. The straps 59 and 62 are joined, as described above, to the female component of the buckle 56. When the male component of buckle 56 is inserted into the female component, the strap segments 53*a*, 53*b*, 59, and 62 abut to form the letter "X" because the buckle does not occupy significant space between them. The result is improved stability of the helmet 51 with respect to the wearer's head.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

The invention claimed is:

1. A retention system for a helmet, the retention system comprising:

a chin-holding component;

a strap buckle; and a strap extending through the strap buckle and having a terminus of a first end secured in position relative to the chin-holding component, a middle portion looped around a helmet component, and a terminus of a second end secured in position relative to the strap buckle, wherein the strap buckle is configured to adjust an overall, non-overlapping length of the strap extending between the chin-holding component and the helmet component, the strap buckle including a frame having a plane and an upper cross-member disposed on the plane, a central cross-member disposed on the plane, and a lower cross-member disposed on the plane, the central cross-member being disposed between the upper cross-member and the lower cross-member and the plane being a flat imaginary reference plane parallel to an axis running through the central cross-member, the strap buckle rotatable about the axis, and the upper cross-member having an inner edge and a flared, finger-engageable outer portion extending outwardly from the plane of the frame, and the lower cross-member having a smooth rounded surface in contact with the strap, wherein movement of the strap buckle toward the chin-holding component to pass a portion of the strap through the strap buckle shortens the overall, non-overlapping length of the strap by an amount equal to the amount that the strap buckle is moved, and wherein the strap buckle is lockable on the strap to prevent lengthening of the overall, non-overlapping length of the strap.

2. The retention system of claim 1 further comprising:

an engagement buckle securing the strap to the chin-holding component, the engagement buckle including first and second mating members each having an abutment surface, joinder of the first and second mating members bringing the abutment surfaces substantially into contact with each other, the strap forming one segment of a V-shaped strap system attached to the first mating member, an apex of the V-shaped strap system being substantially flush with the abutment surface of the first mating member.

3. The retention system of claim 2, wherein the chin-holding component comprises a V-shaped strap system attached to the second mating member and having an apex substantially flush with the abutment surface of the second mating member.

4. The retention system of claim 3, wherein joinder of the first and second mating members brings the apices of the V-shaped strap systems substantially into contact with one another.

5. The retention system of claim 2, wherein the first mating member comprises a pair of flexible fingers and the second mating member comprises engagement surfaces whereby, following joinder, the fingers are held within the second mating member by the engagement surfaces.

6. The retention system of claim 5, wherein the second mating member comprises a pair of openings affording access to the fingers of the first mating member when joined to the second mating member, thereby permitting flexure of the fingers and disjoinder of the first and second mating members.

7. The retention system of claim 1 further comprising:

an engagement buckle securing the strap to the chin-holding component, the engagement buckle including first and second mating members, the strap forming one segment of a first V-shaped strap system attached to the first mating member, the chin-holding component comprising a pair of straps forming a second V-shaped strap system attached to the second mating member, joinder of the first and second mating members aligning opposed straps of the first and second V-shaped strap systems.

8. The retention system of claim 7, wherein at least one of the first and second mating members includes a buckle component having a pair of mounts for two straps forming the first V-shaped strap system, the mounts being angled toward each other to facilitate the alignment.

9. The retention system of claim 8, wherein the mounts are slots extending through the buckle component.

10. The retention system of claim 1 further comprising:

a nape pad, wherein shortening the overall, non-overlapping length of the strap urges the nape pad forward to press against an occipital lobe of a wearer's head.

11. The retention system of claim 1, wherein the helmet component includes a cross-member over which a second end of the strap passes.

12. The retention system of claim 1, wherein the inner edge of the strap buckle is frictionally engaged against the strap to prevent movement of the strap buckle with respect to the strap during operation, and wherein rotation of the strap buckle about the axis, by pulling the upper cross-member in a direction to reduce the friction engagement of the inner edge with the strap, allows the strap buckle to slide with respect to the strap to adjust the overall, non-overlapping length of the strap.

13. A helmet comprising:

a shell having a helmet component;

a chin-holding component;

a strap buckle; and a strap passing through the strap buckle and having a terminus of a first end secured in position relative to the chin-holding component, a middle portion looped around a helmet component, and a terminus of a second end secured in position relative to the strap buckle, wherein the strap buckle is configured to adjust an overall, non-overlapping length of the strap extending between the chin-holding component and the helmet component, the strap buckle including a frame having a plane and an upper cross-member disposed on the plane, a central cross-member disposed on the plane, and a lower cross-member disposed on the plane, the central cross-member being disposed between the upper cross-member and the lower cross-member and the plane being a flat imaginary reference plane parallel to an axis running through the central cross-member, the strap buckle rotatable about the axis, and the upper cross-member having an inner edge and a flared, finger-engageable outer portion extending outwardly from the plane of the frame, and the lower cross-member having a smooth rounded surface in contact with the strap, wherein movement of the strap buckle toward the chin-holding component to pass a portion of the strap through the strap buckle shortens the overall, non-overlapping length of the strap by an amount equal to the amount that the strap buckle is moved, and wherein the strap buckle is lockable on the strap to prevent lengthening of the overall, non-overlapping length of the strap.

14. The helmet of claim 13 further comprising:

an engagement buckle securing the strap to the chin-holding component, the engagement buckle comprising first and second mating members each having an abutment surface, joinder of the first and second mating members bringing the abutment surfaces substantially into contact with one another, the strap forming one segment of a V-shaped strap system attached to the first mating member, an apex of the V-shaped strap system being substantially flush with the abutment surface of the first mating member.

15. The helmet of claim 14, wherein the chin-holding component comprises a V-shaped strap system attached to the second mating member and having an apex substantially flush with the abutment surface of the second mating member.

16. The helmet of claim 15, wherein joinder of the first and second mating members brings the apices of the V-shaped strap systems substantially into contact with one another.

17. The helmet of claim 14, wherein the first mating member comprises a pair of flexible fingers and the second mating member comprises engagement surfaces whereby, following joinder, the fingers are held within the second mating member by the engagement surfaces.

18. The helmet of claim 17, wherein the second mating member comprises a pair of openings affording access to the fingers of the first mating member when joined to the second mating member, thereby permitting flexure of the fingers and disjoinder of the first and second mating members.

19. The helmet of claim 13 further comprising:

an engagement buckle securing the strap to the chin-holding component, the engagement buckle comprising first and second mating members, the strap forming one segment of a first V-shaped strap system attached to the first mating member, the chin-holding component comprising a pair of straps forming a second V-shaped strap system attached to the second mating member, joinder of the first and second mating members aligning opposed straps of the first and second V-shaped strap systems.

20. The helmet of claim 19, wherein at least one of the first and second mating members comprises a buckle component having a pair of mounts for two straps forming the first V-shaped strap system, the mounts being angled toward each other to facilitate the alignment.

21. The helmet of claim 20, wherein the mounts are slots through the buckle component.

22. The helmet of claim 13 further comprising:

a nape pad, wherein shortening the overall, non-overlapping length of the strap urges the nape pad forward to press against an occipital lobe of a wearer's head.

23. The helmet of claim 13 further comprising:

a helmet mount affixed to the shell, the helmet mount comprising a cross-member over which a second end of the strap passes.

24. The helmet of claim 13, wherein the inner edge of the strap buckle is frictionally engaged against the strap to prevent movement of the strap buckle with respect to the strap during operation, and wherein rotation of the strap buckle about the axis, by pulling the upper cross-member in a direction to reduce the friction engagement of the inner edge with the strap, allows the strap buckle to slide with respect to the strap to adjust the overall, non-overlapping length of the strap.

25. A retention system for a helmet, the retention system comprising:

a chin-holding component having a first end and a second end;

an engagement buckle coupled to the second end of the chin-holding component;

a first strap buckle;

a first strap extending through the first strap buckle and having a terminus of a first end secured in position relative to the chin-holding component, a middle portion looped around a first helmet component, and a terminus of a second end secured in position relative to the first strap buckle, the first strap buckle being configured to adjust an overall, non-overlapping length of the first strap extending between the chin-holding component and the first helmet component, the first strap buckle including a frame having a plane and an upper cross-member disposed on the plane, a central cross-member disposed on the plane, and a lower cross-member disposed on the plane, the central cross-member being disposed between the upper cross-member and the lower cross-member and the plane being a flat imaginary reference plane parallel to an axis running through the central cross-member, the strap buckle rotatable about the axis, and the upper cross-member having an inner edge and a flared, finger-engageable outer portion extending outwardly from the plane of the frame, and the lower cross-member having a smooth rounded surface in contact with the first strap, the first strap buckle and the first strap being configured such that movement of the first strap buckle toward the chin-holding component passes a portion of the first strap through the first strap buckle to shorten the overall, non-overlapping length of the first strap by an amount equal to the amount that the first strap buckle is moved, and the first strap buckle being lockable on the first strap to prevent lengthening of the overall, non-overlapping length of the first strap;

a second strap buckle;

a second strap extending through the second strap buckle and having a terminus of a first end secured in position relative to the chin-holding component, a middle portion looped around a second helmet component, and a terminus of a second end secured in position relative to the second strap buckle, the second strap buckle being configured to adjust an overall, non-overlapping length of the second strap extending between the chin-holding component and the second helmet component, the second strap buckle including a frame having a plane and an upper cross-member disposed on the plane, a central cross-member disposed on the plane, and a lower cross-member disposed on the plane, the central cross-member being disposed between the upper cross-member and the lower cross-member and the plane being a flat imaginary reference plane parallel to an axis running through the central cross-member, the strap buckle rotatable about the axis, and the upper cross-member having an inner edge and a flared, finger-engageable outer portion extending outwardly from the plane of the frame, and the lower cross-member having a smooth rounded surface in contact with the second strap, the second strap buckle and the second strap being configured such that movement of the second strap buckle toward the chin-holding component passes a portion of the second strap through the second strap buckle to shorten the overall, non-overlapping length of the second strap by an amount equal to the amount that the second strap buckle is moved, and the second strap buckle being lockable on the second strap to prevent lengthening of the overall, non-overlapping length of the second strap;

a third strap buckle;

a third strap extending through the third strap buckle and having a terminus of a first end secured in position relative to the chin-holding component, a middle portion looped around a third helmet component, and a terminus of a second end secured in position relative to the third strap buckle, the third strap buckle being configured to adjust an overall, non-overlapping length of the third strap extending between the chin-holding component and the third helmet component, the third strap buckle including a frame having a plane and an upper cross-member disposed on the plane, a central cross-member disposed on the plane, and a lower cross-member disposed on the plane, the central cross-member being disposed between the upper cross-member and the lower cross-member and the plane being a flat imaginary reference plane parallel to an axis running through the central cross-member, the strap buckle rotatable about the axis, and the upper cross-member having an inner edge and a flared, finger-engageable outer portion extending outwardly from the plane of the frame, and the lower cross-member having a smooth rounded surface in contact with the third strap, the third strap buckle and the third strap being configured such that movement of the third strap buckle toward the chin-holding component passes a portion of the third strap through the third strap buckle to shorten the overall, non-overlapping length of the third strap by an amount equal to the amount that the third strap buckle is moved, and the third strap buckle being lockable on the third strap to prevent lengthening of the overall, non-overlapping length of the third strap;

a fourth strap buckle; and a fourth strap extending through the fourth strap buckle and having a terminus of a first end secured in position relative to the chin-holding component, a middle portion looped around a fourth helmet component, and a terminus of a second end secured in position relative to the fourth strap buckle, the fourth strap buckle being configured to adjust an overall, non-overlapping length of the fourth strap extending between the chin-holding component and the fourth helmet component, the fourth strap buckle including a frame having a plane and an upper cross-member disposed on the plane, a central cross-member disposed on the plane, and a lower cross-member disposed on the plane, the central cross-member being disposed between the upper cross-member and the lower cross-member and the plane being a flat imaginary reference plane parallel to an axis running through the central cross-member, the strap buckle rotatable about the axis, and the upper cross-member having an inner edge and a flared, finger-engageable outer portion extending outwardly from the plane of the frame, and the lower cross-member having a smooth rounded surface in contact with the fourth strap, the fourth strap buckle and the fourth strap being configured such that movement of the fourth strap buckle toward the chin-holding component passes a portion of the fourth strap through the fourth strap buckle to shorten the overall, non-overlapping length of the fourth strap by an amount equal to the amount that the fourth strap buckle is moved, and the fourth strap buckle being lockable on the fourth strap to prevent lengthening of the overall, non-overlapping length of the fourth strap, wherein the first strap is coupled to the second strap forming a first V-shaped strap system and the third strap coupled to the fourth strap forming a second V-shaped strap system, the first V-shaped strap system coupled to the first end of the chin-holding component, and the second V-shaped strap system coupled to the engagement buckle.

26. The retention system of claim 1, wherein the second end of the strap includes a closed loop around the central cross-member of the strap buckle.

27. The retention system of claim 1, wherein the movement of the strap buckle toward the chin-holding component causes the terminus of the second end of the strap to move away from the helmet component.

28. The retention system of claim 1, wherein the central cross-member is positioned between the lower cross-member and the upper cross-member, wherein the central cross-member is positioned on a first side of the strap, and wherein the upper cross-member and the lower cross-member are positioned on a second side of the strap that is opposite the first side of the strap.

29. The retention system of claim 1, wherein the terminus of second end is secured to the central cross-member of the strap buckle.

30. The retention system of claim 1, wherein the upper cross-member is fixedly attached to the frame of the strap buckle.

31. The retention system of claim 1, wherein the upper cross-member, the central cross-member, and the lower cross-member are all integrally formed with the frame.

32. The retention system of claim 1, further comprising a central plane extending through the helmet component and the central cross-member, wherein when the strap buckle is rotated about the central cross-member, the upper cross-member and the lower cross-member are on opposite sides of the central plane.

33. The retention system of claim 25, wherein the first helmet component includes a first screw that is configured to extend through a first pre-existing throughhole of the helmet and the third helmet component includes a second screw that is configured to extend through a second pre-existing throughhole of the helmet.

34. The retention system of claim 33, wherein the second helmet component is coupled to a fifth strap which is coupled to a fifth helmet component that includes a third screw that extends through a third pre-existing throughhole of the helmet and the fourth helmet component is coupled to a sixth strap which is coupled to a sixth helmet component that includes a fourth screw configured to extend through a fourth pre-existing throughhole of the helmet.

35. A retention system for a helmet, the retention system comprising:

a chin-holding component having a first end and a second end;

an engagement buckle coupled to the second end of the chin-holding component;

a nape pad;

a first strap buckle;

a first strap extending through the first strap buckle and having a terminus of a first end secured in position relative to the chin-holding component, a middle portion looped around a first helmet component, and a terminus of a second end secured in position relative to the first strap buckle, the first strap buckle being configured to adjust an overall, non-overlapping length of the first strap extending between the chin-holding component and the first helmet component, the first strap buckle including a frame having a plane and an upper cross-member, a central cross-member, and a lower cross-member, the lower cross-member in contact with the first strap, the first strap buckle and the first strap being configured such that movement of the first strap buckle toward the chin-holding component passes a portion of the first strap through the first strap buckle to shorten the overall, non-overlapping length of the first strap by an amount equal to the amount that the first strap buckle is moved, and the first strap buckle being lockable on the first strap to prevent lengthening of the overall, non-overlapping length of the first strap;

a second strap buckle;

a second strap extending through the second strap buckle and having a terminus of a first end secured in position relative to the chin-holding component, a middle portion looped around a second helmet component, and a terminus of a second end secured in position relative to the second strap buckle, the second strap buckle being configured to adjust an overall, non-overlapping length of the second strap extending between the chin-holding component and the second helmet component, the second strap buckle including a frame having a plane and an upper cross-member, a central cross-member, and a lower cross-member, the lower cross-member in contact with the second strap, the second strap buckle and the second strap being configured such that movement of the second strap buckle toward the chin-holding component passes a portion of the second strap through the second strap buckle to shorten the overall, non-overlapping length of the second strap by an amount equal to the amount that the second strap buckle is moved, and the second strap buckle being lockable on the second strap to prevent lengthening of the overall, non-overlapping length of the second strap;

a third strap buckle;

a third strap extending through the third strap buckle and having a terminus of a first end secured in position relative to the chin-holding component, a middle portion looped around a third helmet component, and a terminus of a second end secured in position relative to the third strap buckle, the third strap buckle being configured to adjust an overall, non-overlapping length of the third strap extending between the chin-holding component and the third helmet component, the third strap buckle including a frame having a plane and an upper cross-member, a central cross-member, and a lower cross-member, the lower cross-member in contact with the third strap, the third strap buckle and the third strap being configured such that movement of the third strap buckle toward the chin-holding component passes a portion of the third strap through the third strap buckle to shorten the overall, non-overlapping length of the third strap by an amount equal to the amount that the third strap buckle is moved, and the third strap buckle being lockable on the third strap to prevent lengthening of the overall, non-overlapping length of the third strap;

a fourth strap buckle; and a fourth strap extending through the fourth strap buckle and having a terminus of a first end secured in position relative to the chin-holding component, a middle portion looped around a fourth helmet component, and a terminus of a second end secured in position relative to the fourth strap buckle, the fourth strap buckle being configured to adjust an overall, non-overlapping length of the fourth strap extending between the chin-holding component and the fourth helmet component, the fourth strap buckle including a frame having a plane and an upper cross-member, a central cross-member, and a lower cross-member, the lower cross-member in contact with the fourth strap, the fourth strap buckle and the fourth strap being configured such that movement of the fourth strap buckle toward the chin-holding component passes a portion of the fourth strap through the fourth strap buckle to shorten the overall, non-overlapping length of the fourth strap by an amount equal to the amount that the fourth strap buckle is moved, and the fourth strap buckle being lockable on the fourth strap to prevent lengthening of the overall, non-overlapping length of the fourth strap, wherein the first strap is coupled to the second strap forming a first V-shaped strap system and the third strap coupled to the fourth strap forming a second V-shaped strap system, the first V-shaped strap system coupled to the first end of the chin-holding component, and the second V-shaped strap system coupled to the engagement buckle wherein the second helmet component is coupled to a fifth strap and the fourth helmet component is coupled to a sixth strap, the fifth strap and the sixth strap each being slidingly coupled to the nape pad.

36. The retention system of claim 35, wherein the fifth strap and the sixth strap overlap with one another.

37. The retention system of claim 35, wherein the nape pad includes an adjustment mechanism for reducing the distance between the nape pad and a back of a user's head when the user's head is disposed within the helmet.

* * * * *